US005305961A

United States Patent [19]

Errard et al.

[11] Patent Number: 5,305,961

[45] Date of Patent: Apr. 26, 1994

[54] METHOD OF WINDING AN ELECTRICAL COIL AS SUCCESSIVE OBLIQUE LAYERS OF COIL TURNS

[75] Inventors: Alain Errard, Malaunay; Roger Bourgeon, Sotteville, both of France

[73] Assignee: GEC Alsthom SA, Paris, France

[21] Appl. No.: 897,642

[22] Filed: Jun. 12, 1992

[30] Foreign Application Priority Data

Jun. 14, 1991 [FR] France ..... 91 07327

[51] Int. Cl.[5] ..... H01F 15/10

[52] U.S. Cl. ..... 242/7.03; 29/605

[58] Field of Search ..... 242/7.03, 7.08, 7.09; 29/605

[56] References Cited

U.S. PATENT DOCUMENTS

| | | | |
|---|---|---|---|
| 3,886,434 | 5/1975 | Schreiner . | |
| 4,668,544 | 5/1987 | Takahashi | 242/7.03 X |
| 5,114,086 | 5/1992 | Ho | 242/7.03 |

FOREIGN PATENT DOCUMENTS

| | | |
|---|---|---|
| 829334 | 2/1950 | Fed. Rep. of Germany . |
| 1299751 | 2/1970 | Fed. Rep. of Germany . |
| 717497 | 10/1931 | France . |
| 2410346 | 6/1979 | France . |
| 254093 | 4/1948 | Switzerland . |

*Primary Examiner*—Andrew M. Falik
*Attorney, Agent, or Firm*—Sughrue, Mion, Zinn, Macpeak & Seas

[57] ABSTRACT

An electrical coil is created by winding an electrical coil as successive parallel oblique layers of coil turns projecting radially outwardly from a coil former about which the coil turns are wound with the coil turns positioned radially outward of the coil former axis. The winding forms in radial cross-section, a triangle having a base situated against the coil former, a second side constituting an oblique rising edge and a third oppositely oblique side. Alternately upward and downward oblique coil turn layers are successively wound to advance the coil progressively along the axis of the former. To effect a connection to an adjustment tap on a turn n which in normal winding would not be on the radially outer layer of coil turns extending parallel to the winding axis but rather buried within the coil, such succeeding coil turn n of either the downwardly oblique coil turn winding layer or upward oblique coil turn winding layer extending parallel to the third side of the trapezium is left free, and the turn n which would be normally buried in the coil is placed in the last coil turn space of the next upwardly oblique coil turn layer on the outer periphery of the electrical coil to properly position its adjustment tap.

1 Claim, 3 Drawing Sheets

METHOD OF WINDING AN ELECTRICAL COIL AS SUCCESSIVE OBLIQUE LAYERS OF COIL TURNS

BACKGROUND OF THE INVENTION

1. Field of the invention

The present invention concerns a method of winding an electrical coil.

The invention applies more particularly to transformer windings, especially high-voltage windings.

2. Description of the prior art

It is known to wind oblique layers with flattened turns perpendicular to the winding axis. As compared with a conventional coil with horizontal layers of contiguous helical turns, this reduces the maximum voltage between turns of successive layers and therefore makes it possible to reduce the thickness of the insulation between layers and in some instances to eliminate it entirely.

FIG. 4 of French patent 717 497 and the relevant text from page 5, line 82 through page 6, line 84 show and describe a coil with 70 turns in 20 oblique layers. The first layer comprises only one turn, the second layer comprises two turns, the third layer also comprises two turns, the fourth layer comprises three turns, the fifth layer comprises four turns, the sixth layer comprises four turns, the seventh through fourteenth layers each comprise five turns, the fifteenth layer comprises four turns, the sixteenth and seventeenth layers each comprise three turns, the eighteenth layer comprises two turns and the nineteenth and twentieth layers each comprise one turn. The layers are at 30° to the horizontal.

These 70 turns wound in 20 oblique layers form five horizontal layers as can be seen in the aforementioned FIG. 4.

Numbering the turns in consecutive winding order it is found that the inner horizontal layer comprises turns 1, 2, 5, 6, 12, 13, 21, 22, 31, 32, 41, 42, 51 and 52 and that the outer horizontal layer comprises turns 17, 26, 27, 36, 37, 46, 47, 56, 57, 63, 64, 68, 69 and 70.

A first drawback of this coil is that it requires lateral flanges to retain the turns.

A second drawback results from the fact that, as noted above, the turns of the outer horizontal layer are not consecutive. As a result, if voltage adjusting tape are required, it is not usually possible to obtain a precise adjustment accurate to the voltage of one turn. The adjustment is usually performed in the following manner. If adjustment is required to a voltage 2.5% lower than the total nominal voltage, two taps are formed on the outer turns, the number of turns between the two taps having to be that required to obtain the 2.5% lower voltage. The adjustment is made by bridging between the two taps each connected to a connector. It is therefore clear that in an oblique layer coil as described in the document cited above the voltage cannot be adjusted accurate to the voltage of one turn because the turns of the outer horizontal layer are not consecutive.

The first drawback of this coil is eliminated by the document CH-A-254 093 which describes an oblique layer winding whose half-section in a plane through its axis is trapezium-shaped. The coil thus forms a stable assembly requiring no flanges. To make the coil the first step is to execute a winding with a triangular cross-section.

However, the second above drawback relating to the adjustment tape is not eliminated.

An object of the present invention is to alleviate this drawback.

SUMMARY OF THE INVENTION

The present invention consists in a method of winding an electrical coil in oblique layers of plane turns perpendicularly to the winding axis, the change from one turn to the next being effected by means of an offset, the half-section of the coil in a plane containing its axis being in the shape of a trapezium, the coil constituting a self-supporting stable mechanical assembly, the turns on the oblique sides of the trapezium, with the exception of the two turns at respective opposite ends of the longer parallel side of the trapezium, resting on two turns in a layer parallel to the winding axis, winding being started by forming in said cross-section a triangle having a base situated against a coil former, a second side constituting a rising edge and a third side parallel to which are subsequently placed, alternately upward and downward, subsequent oblique layers causing the coil to advance progressively along the axis of the former, the point at which the rising edge meets the third side defining the greatest diameter of said trapezium, each turn of the rising edge except for the first resting on two successive turns in the same layer parallel to the winding axis and wound before, but not immediately before the turn of the rising edge, the first of said two turns being the previous turn of the rising edge, in which method, when it is required to place a connector to make an adjustment tap on a turn n which in normal winding would not be on the outer layer parallel to the winding axis but buried in the coil, winding proceeds as follows:

if said turn n is a turn normally placed during downward winding parallel to said third side:

after placing the last turn $(n-x)$ in the upward direction turn $(n-x-1)$ is placed where turn $(n-x+2)$ would normally be placed, to leave one turn location free, following which downward winding continues normally, so that each turn is at the location normally for the next turn, until turn $(n-1)$ is placed at the location normally intended for turn n, turn n is then placed in the location left free, in which turn $(n-x+1)$ would normally have been placed, turn $(n+1)$ is then placed in downward winding in the location which follows turn $(n-1)$, that is to say that said turn is placed in its normal location and downward winding continues normally, if said turn n is a turn normally placed during upward winding parallel to said third side: initially the turns are normally placed in the upward direction up to and including turn $(n-1)$ after which the turn n is placed at the top of the upwardly wound layer, that is to say at the top of the trapezium, after which downward winding is continued until the location in which turn n would normally be placed is filled, and finally the first turn of the next upward winding is placed on the inside diameter against the former and winding continues normally.

One embodiment of the invention will now be described with reference to the appended drawings.

DETAILED DESCRIPTION OF THE INVENTION

Figure 1:
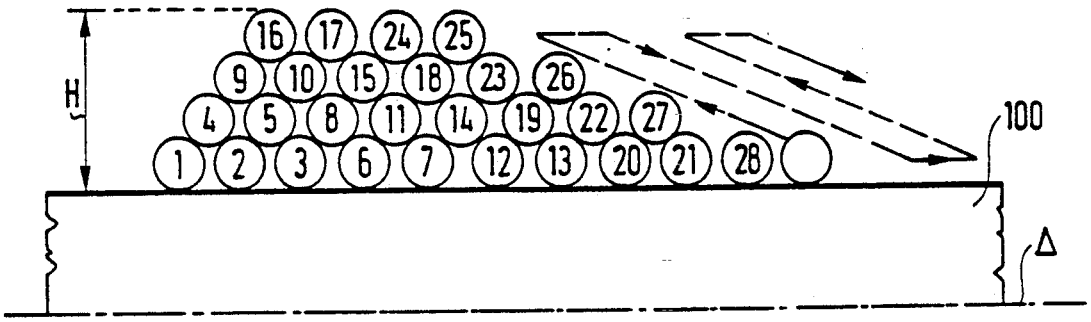
FIG. 1 is a diagram showing in cross-section through a plane containing the coil axis a method in accordance with the invention of winding a coil with the turns numbered in the order in which they are wound.
Figure 2:
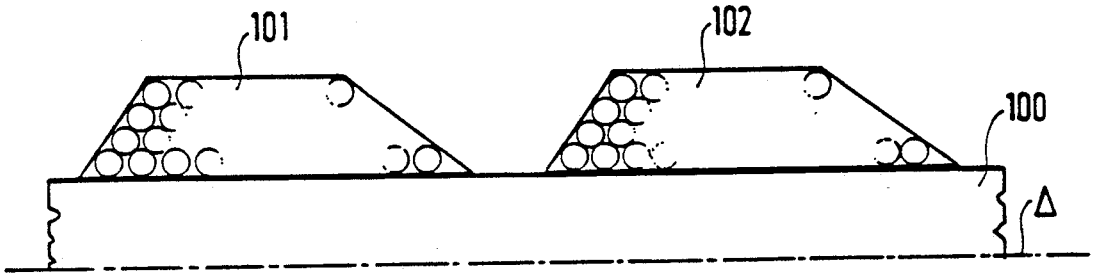
FIG. 2 shows in half-section in a plane containing the coil axis a coil comprising two windings in series on the same former.

Referring to FIG. 1, a coil with 29 numbered turns is wound onto a former 100. The turns are numbered in winding order. The winding method gradually increases the diameter of the coil until it reaches its greatest value, at turn 16 in this example, at which time the cross-section of the coil in the half-plane shown in the figure is triangular with a first side constituting a horizontal layer comprising turns 1, 2, 3, 6, 7, 12 and 13, a second side forming an oblique rising edge comprising turns 1, 4, 9 and 16 and a third side comprising turns 13, 14, 15 and 16. Winding continues with a succession oblique turns wound downwards and then upwards parallel to the third side formed by the turns 13, 14, 15 and 16. A downward oblique layer is therefore formed by turns 17, 18, 19 and 20 and is followed by an upward layer formed by turns 21, 22, 23 and 24, etc. The coil therefore grows at constant height H along the axis Δ of the former 100. The cross-section of the coil in the half-plane shown in the figures is therefore a trapezium. FIG. 2 shows two windings 101, 102 wound successively in series onto the same former 100.

The turns are all plane and perpendicular to the axis Δ and they are not wound helically. The change from one turn to the next, irrespective of its location, is achieved by means of an offset in the known way as shown, for example, in FIG. 2 of French patent 717 497.

The coil formed this way is perfectly stable, self-supporting and requires no lateral flanges to retain it. The rising edge turns 1, 4, 9, 16 are well "seated". Turn 1 is directly in contact with the former; turn 4 rests on turns 1 and 2, turn 9 rests on turns 4 and 5 and turn 16 rests on turns 9 and 10. As winding begins with three consecutive turns 1, 2, 3 wound directly onto the former, when turn 4 is placed on turns 1 and 2 the latter turn 2 is already retained by turn 3. Along the other oblique side of the trapezium each turn also rests on two turns in a layer parallel to the axis, as do all the turns of the coil except for those on the longer parallel side of the trapezium which are in direct contact with the former 100.

As there are no lateral flanges it is a simple matter to wind a plurality of windings in series automatically onto the same former as shown in FIG. 2.

Figure 3:
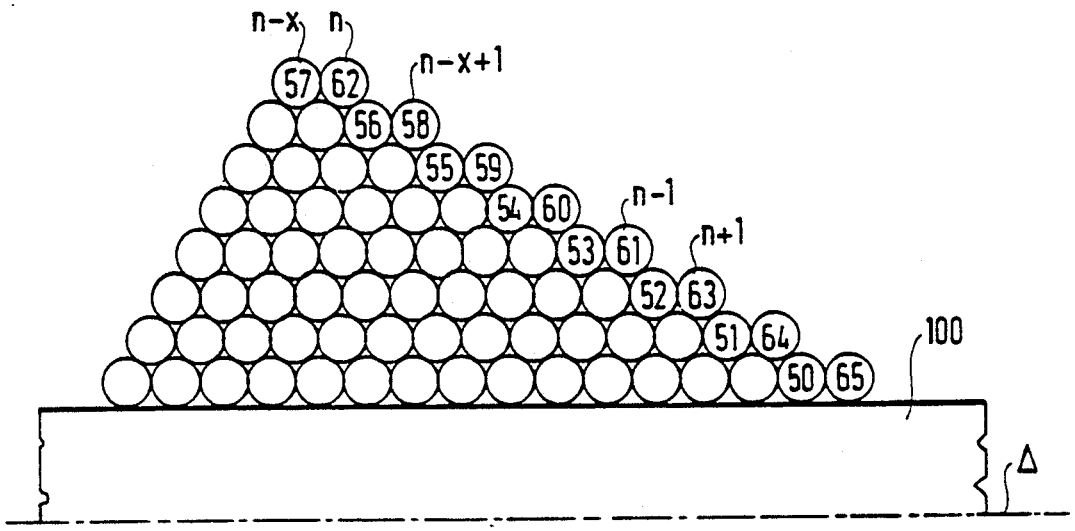
FIGS. 3 and 4 show two different applications of a method in accordance with the invention to obtaining on the outer layer turns which would normally be on inner layers, with a view to providing adjustment taps.

FIG. 3 shows the method of placing on the outer horizontal layer, that is to say on the shorter parallel side of the trapezium, while winding the turns of a downward oblique layer, a turn which would normally be located further down the slope and therefore covered by subsequent oblique layers, with a view to using this turn as an adjustment tap.

To show this method the turns are numbered in the order they are executed from turn 50 taken arbitrarily as a convenient example. The turn n to be placed on the outer layer is turn 62.

When turn $n-x=57$ has been placed, turn $n-x+1=58$ is not placed where it would normally be placed but instead this location is skipped to place it one step further on, following which turns 59, 60 and 61 are each placed one step further forward than their normal place and turn $n=62$ is placed on the outer layer at the location left free, alongside turn 57, after which turn 63 is wound into its normal place and further winding continues as normal.

Figure 4:
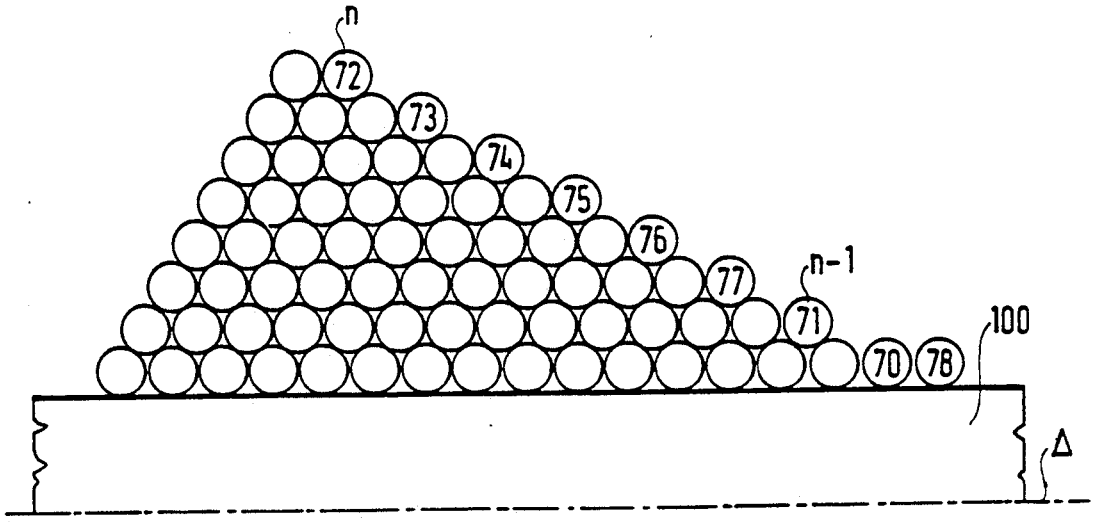

FIG. 4 shows the situation in which the turn to be placed on the outer layer is a turn which is normally in an upward oblique layer. This is the turn $n=72$. Here the turns are numbered from an arbitrarily selected start turn 70. When turn $n-1=71$ has been placed, turn $n=72$ is placed directly at the top on the short parallel side of the trapezium, that is to say on the outer horizontal layer. Turns 73, 74, 75, 76 and 77 are then placed as in winding a downward layer until the oblique layer is full and turn 78 is placed directly against the former 100 to start a new upward layer.

It has therefore been shown how it is possible (once the original triangle has been completed) to place any turn of a complete oblique layer on the outer horizontal layer. It is therefore possible to adjust the voltage to an accuracy equal to the voltage of one turn by bridging two taps on two turns of the outside horizontal layer.

Figure 5:
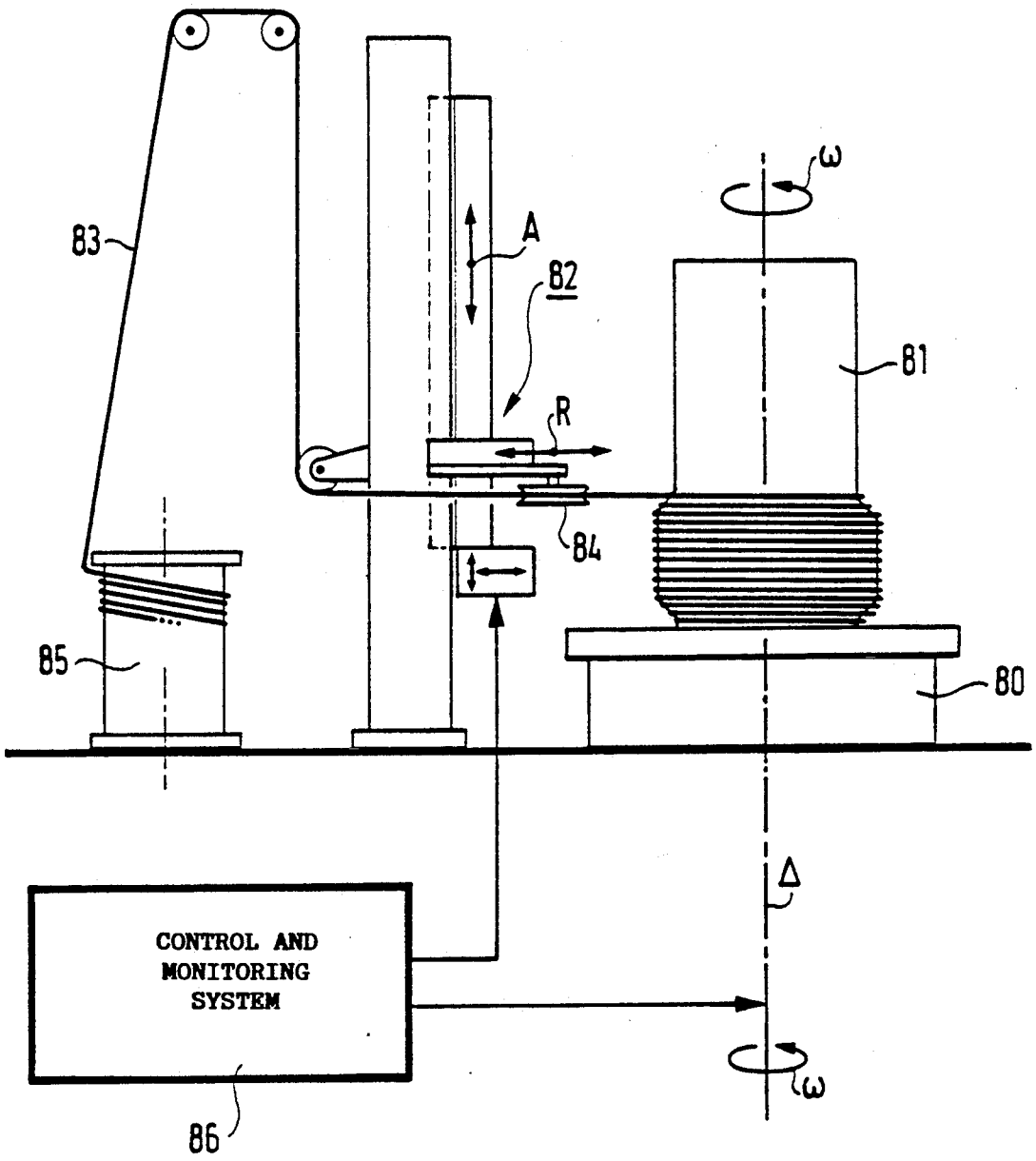
FIG. 5 is a diagram showing an installation for winding coils by a method in accordance with the invention.

FIG. 5 is a highly diagrammatic representation of an installation for carrying out winding as described above automatically. The system comprises a welded construction support structure 80, a cylindrical former 81 with a vertical axis driven in rotation, a system 82 for unwinding the pilot wire 83 which guides the wire axially parallel to the axis of the former and also moves the wire guide pulley 84 radially, a spool 85 of wire and a control and monitoring system 86 controlling:

the rotation speed of the former, the axial A and radial R displacements of the unwinding system 82, the characteristics of the coil: number of layers, position of adjustment taps, wire diameter, etc.

There is claimed:

1. In a method of oblique winding of an electrical coil by winding said coil as successive parallel oblique layers of coil turns perpendicular to a winding axis of a coil former and effecting a change from one turn to the next turn by axially offsetting said one turn from said next turn, the improvement wherein:

said step of winding said coil as successive parallel oblique layers of coil turns comprises;

winding coil turns in the form of a triangle about said winding axis, having in radial cross-section through said winding axis one side as a base of said triangle situated against said coil former, a second side constituting an oblique rising edge and a third, oppositely oblique side, and winding sequentially alternately oppositely upward and downward oblique coil turn layers parallel to said third, oppositely oblique side thereby causing the coil to advance progressively along the axis of the coil former, such that a half-section of said coil in a radial plane containing said winding axis is in the form of a trapezium with said coil constituting a self-supporting stable mechanical assembly, and with coil turns on oblique sides of the trapezium, with the exception of two turns at respective opposite ends of a longer parallel side of the trapezium, resting on two turns in a coil layer extending parallel to the winding axis, and wherein a point at which said oblique rising edge meets said third oppositely oblique side defines the radial extremity of said trapezium, with each coil turn of the rising edge except for a first coil turn resting on two successive turns in the same layer parallel to the winding axis, the first of said turns being a previous turn of a rising edge, skipping placement of a coil turn n for making an adjustment tap during one of downwardly oblique coil turn winding and upwardly oblique coil turn winding; thereby leaving one turn location free, and continuing winding of succeeding coil turns from said one turn location free until reaching the last coil turn of a succeeding alternately oppositely upward oblique coil turn layer, and thereafter placing said skipped turn n at the top of the upwardly wound oblique coil turn layer at the top of the trapezium, and further continuing said coil winding in a succeeding downwardly oblique coil turn layer.

* * * * *